United States Patent [19]

Baker

[11] 3,960,287

[45] June 1, 1976

[54] EASY-OPEN ECOLOGY CROWN CAP

[75] Inventor: Charles T. Baker, Rutland, Vt.

[73] Assignee: Vermont Marble Company, Proctor, Vt.

[22] Filed: May 5, 1975

[21] Appl. No.: 574,703

[52] U.S. Cl. ..... 215/253
[51] Int. Cl.[2] ..... B65D 41/42
[58] Field of Search ..... 215/235, 253; 220/268

[56] References Cited

UNITED STATES PATENTS

| | | | |
|---|---|---|---|
| 1,723,790 | 8/1929 | Kirkland | 215/253 |
| 1,866,841 | 7/1932 | Crookshank | 215/253 |
| 2,102,440 | 12/1937 | Sebell | 215/253 X |
| 3,779,417 | 12/1973 | Klein | 220/268 |
| 3,794,206 | 2/1974 | Deline | 220/268 |
| 3,812,992 | 5/1974 | Wolf | 215/253 |
| 3,880,316 | 4/1975 | Martella | 220/268 |

*Primary Examiner*—Donald F. Norton
*Attorney, Agent, or Firm*—Bacon & Thomas

[57] ABSTRACT

The depressed dome portion of the cap is scored part way through the thickness of the material thereof and immediately adjacent the inner periphery of the overlying ring portion. The score forms a continuous line extending nearly completely around the dome portion but interrupted for a short distance to provide an unscored hinge portion. The depth of the score is sufficient to allow downward finger pressure on the dome portion to break the material thereof along the score line and permit the dome portion of the cap to be bent downwardly about the hinge portion and into the neck of the bottle to which the cap is attached.

4 Claims, 5 Drawing Figures

EASY-OPEN ECOLOGY CROWN CAP

This invention relates to a novel crown cap capable of being manually opened without removing the cap from the bottle to which it is attached.

It is an object of this invention to provide a bottle cap which may be safely opened by finger pressure and still remain attached to the bottle.

Another object of the invention is to provide a bottle with a bottle cap which may be ruptured by finger pressure to provide an opening without danger of cutting the finger on the exposed edge of the opening.

These and other objects and advantages of the invention will become more apparent from the following specification when taken in conjunction with the drawings in which.

Figure 1:
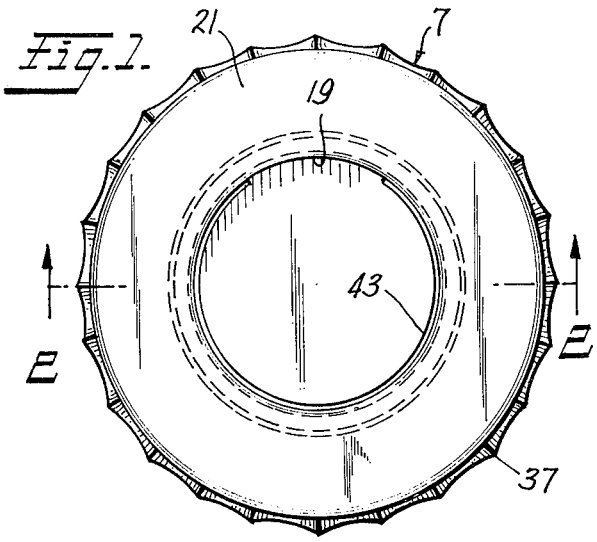
FIG. 1 is a top plan view of a bottle cap according to the present invention.
Figure 3:
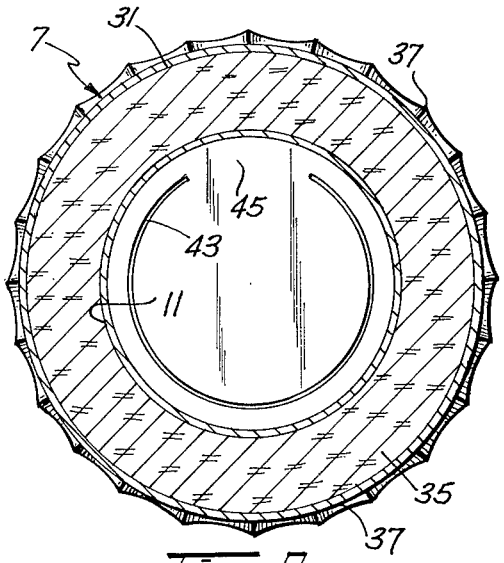
FIG. 3 is a view taken on the line 3—3 of FIG. 2.
Figure 2:
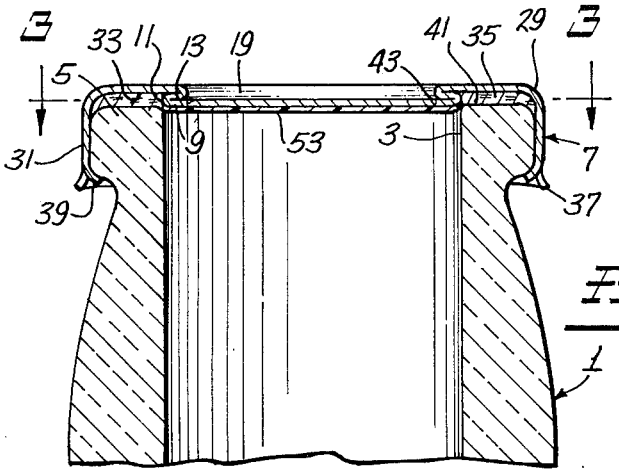
FIG. 2 is a fragmentary view of the upper end of a bottle with a bottle cap according to the invention attached thereto.
Figure 4:
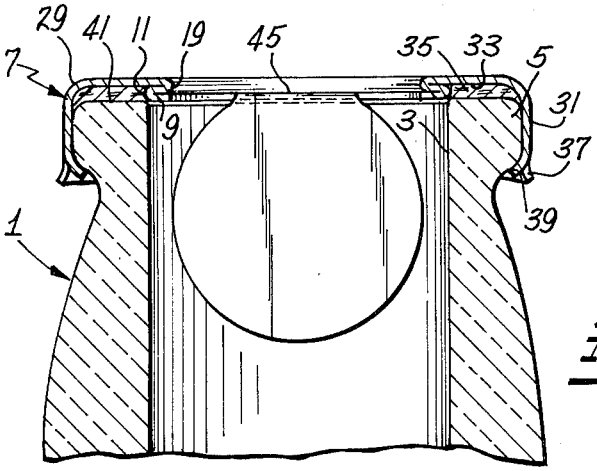
FIG. 4 is a fragmentary cross-sectional view similar to that of FIG. 2 showing the bottle cap in the opened position.

The present bottle cap is shown in FIGS. 2 and 4 attached to a bottle 1 having a circular outlet opening 3 and with an annular bead 5 extending around the mouth of the opening.

The bottle cap 7 may be formed from conventional sheet material such as metal or plastic.

The bottle cap is formed with a planer circular central dome portion 9 which extends across the opening 3 at the mouth of the bottle and the diameter of the dome portion is preferably substantially the same as or slightly smaller than the diameter of the circular opening 3 at the mouth of the bottle.

The bottle cap 7 is of integral, one-piece construction as shown in the drawings. The sheet material from which the bottle cap 7 is formed, extends radially inwardly from the periphery 11 of the dome portion 9 to provide an annular ring portion 13 disposed with its lower side 15 abutment with the opposed upper surface 17 of the dome portion 9. Thus, the outer periphery 11 of the dome portion 9 is co-extensive with the outer periphery of the annular ring portion 13.

The bottle cap sheet material extends radially outwardly from the inner periphery 19 of the annular ring portion 13 to provide an annular top wall portion 21. The portion 23 of the lower surface 25 of the top wall portion 21 is in abutment with the opposed upper surface 27 of the annular ring portion 13.

The bottle cap material extends downwardly from the outer periphery 29 of the top wall portion 21 to provide an annular flange portion 31 spaced radially outwardly from the outer periphery 11 of the dome and annular ring portions 9 and 13 so as to provide an annular channel 33 in which a suitable annular sealing gasket 35 is installed. The lower edge 37 of the annular flange portion 31 is crimped as at 39 for fastening the bottle cap 7 to bottle 1 with the gasket 35 in sealing engagement with the upper end 41 of the bottle.

Figure 5:
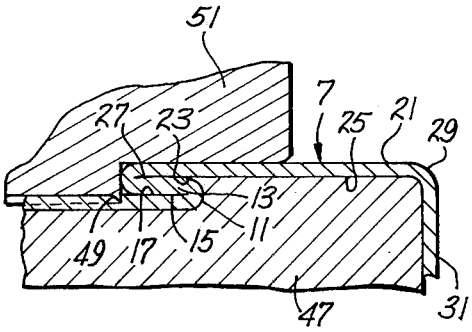
FIG. 5 is an enlarged, fragmentary, cross-sectional view of a bottle cap and means for forming a score line therein.

The dome portion 9 is scored part way through the thickness of the bottle cap material from its top surface downwardly and immediately adjacent the inner periphery 19 of the annular ring portion 13 and the top wall portion 21. The score line 43 is circular and forms a continuous line extending nearly all of the way around the dome portion at the inner edge of the ring portion. The score, however, is interrupted for a short distance to provide an unscored hinge portion 45. The score in the dome portion 9 of the bottle cap 7 may be formed as shown in FIG. 5 by supporting a bottle cap on a suitably formed, fixed, rigid member 47 and scoring the dome portion 9 in vertical alignment with the inner periphery of the ring portion 13 by means of a suitable cutting edge 49 carried by a part 51, the bottle cap 7 being confined between the rigid member 47 and the part 51 when the score 43 is formed in the dome portion 9. Preferably the part 51 moves vertically with respect to the rigid member 47 for supplying bottle caps to be scored to the rigid member 47, for forming the score and for removing scored bottle caps.

After the bottle cap is formed by folding or bending the material in the manner described above and the dome portion is scored nearly circumferentially around the inner periphery 19 of the annular ring portion 13, the bottle cap is then completed by installing the sealing gasket 35 which may be a sealing compound, and by coating over the lower surface of the dome portion 9, as indicated at 53, with a suitable material as established by the prior art.

In use, a bottle closed and sealed with the present bottle cap, is opened by applying finger pressure to the dome portion at a point opposite the unscored hinge portion 45 with sufficient force to rupture the bottle cap material along the score line and by then bending the central portion of the dome downwardly by the finger to the position shown in FIG. 4. The bottle cap 7 remains attached to the bottle 1 and is returned with the bottle for recycling or for disposal. Since the lower surface 15 of the ring portion 13 is abutted against the opposed upper surface 17 of the upper surface of the dome portion 9, there will be no space for liquid being dispensed from the bottle to enter and accumulate between the dome 9 and the ring portion 13.

By scoring the dome portion immediately below the inner periphery 19 of the annular ring portion 13, any burr which might be formed on the dome portion underlying the annular ring portion 13 when the central portion of the dome portion is ruptured along the score 43, would be in line with or covered by this folded portion so that the danger of cutting the finger opening the bottle would be greatly reduced or eliminated.

It will be understood that the invention is not to be limited to the exact construction shown and described but that various changes and modifications may be made without departing from the spirit and scope of the invention, as defined in the appended claims.

What I claim is:

1. An integral bottle cap for a bottle having a circular outlet opening and an annular bead extending around the mouth of said opening, comprising: a depressed, substantially planer, circular central dome portion; an annular ring portion extending inwardly from the periphery of said dome portion with its lower surface in abutment with the opposed surface of said dome portion; an annular top wall portion extending outwardly from the inner edge of said annular ring portion with the upper surface of said ring portion in abutment with the lower opposed surface of said top wall portion, and an annular flange portion depending from the outer periphery of said top wall portion with its lower edge adapted to be crimped under the bead at the mouth of the bottle, said dome portion being scored only part way through the thickness of the material thereof from its top surface downwardly and in vertical alignment with the inner edge of said ring portion, the score forming a line extending around the dome portion and being interrupted to provide an unscored hinge portion, the depth of said score being sufficient to allow downward finger pressure on the center of said dome portion to break the cap material along the score line and permit the center of the dome portion to move downwardly about the hinge portion and into the upper end of the neck of the bottle.

2. A bottle cap according to claim 1 in which the inner periphery of said ring portion, the inner periphery of said top wall portion and said score line are each substantially equidistant from the center of said dome portion.

3. A bottle cap according to claim 1 in which the outer periphery of the top wall portion extends radially outwardly beyond the periphery of said annular ring portion and defines with the opposed portion of said annular flange an annular channel, and an annular sealing gasket is disposed in said annular channel.

4. A bottle cap according to claim 3 fixed to a bottle having a circular outlet opening and an annular bead extending around the mouth of said opening with said annular sealing gasket in sealing contact with the upper surface of said annular bead and with the lower edge of said annular flange portion crimped under the lower edge of said bead, the outer diameter of said dome portion being substantially the same as or smaller than the inner diameter of the circular outlet opening at the mouth of the bottle.

* * * * *